US006623372B1

(12) United States Patent
Beebe et al.

(10) Patent No.: US 6,623,372 B1
(45) Date of Patent: Sep. 23, 2003

(54) GOLF PUTTER WITH ADJUSTABLE SHAFT AND ADJUSTABLE HOSEL

(75) Inventors: Lou C. Beebe, Phoenix, AZ (US); John P. Fife, Jr., Phoenix, AZ (US); James Wells, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 10/150,787

(22) Filed: May 17, 2002

(51) Int. Cl.[7] ..... A63B 53/06

(52) U.S. Cl. ..... 473/231; 473/246; 473/248; 473/314

(58) Field of Search ..... 473/231, 239, 473/246, 248, 252, 253, 254, 296, 305, 307, 313, 314

(56) References Cited

U.S. PATENT DOCUMENTS

| | | | | | |
|---|---|---|---|---|---|
| 1,535,707 | A | * | 4/1925 | Barnes | 473/248 |
| 1,550,665 | A | * | 8/1925 | Barnes | 473/248 |
| 1,599,336 | A | * | 9/1926 | Lindgren | 473/248 |
| 1,943,066 | A | * | 1/1934 | Ford | 473/239 |
| 2,091,794 | A | * | 8/1937 | Pester | 473/245 |
| 2,107,983 | A | * | 2/1938 | Hamilton | 473/296 |
| 2,155,830 | A | | 4/1939 | Howard | |
| 3,096,982 | A | * | 7/1963 | Bassin | 473/248 |
| 3,214,169 | A | * | 10/1965 | Rupnow | 473/246 |
| 3,528,660 | A | * | 9/1970 | Kategian | 473/296 |
| 3,931,969 | A | * | 1/1976 | Townhill | 473/246 |
| 4,073,492 | A | | 2/1978 | Taylor | |
| 4,104,802 | A | * | 8/1978 | Johnston | 33/508 |
| 4,569,523 | A | | 2/1986 | Jarvin | |
| 4,735,414 | A | | 4/1988 | Williams | |
| 4,736,951 | A | | 4/1988 | Grant | |
| 4,815,740 | A | | 3/1989 | Williams | |
| 5,083,779 | A | * | 1/1992 | Ungermann | 473/239 |
| 5,244,205 | A | | 9/1993 | Melanson | |
| 5,253,869 | A | * | 10/1993 | Dingle et al. | 473/245 |
| 5,282,619 | A | * | 2/1994 | Napolitano et al. | 473/239 |
| 5,292,123 | A | | 3/1994 | Schmidt, Jr. | |
| 5,308,063 | A | | 5/1994 | Vendur | |
| 5,320,346 | A | | 6/1994 | Phillips | |
| 5,390,918 | A | | 2/1995 | Meyers | |
| 5,390,919 | A | | 2/1995 | Stubbs | |
| 5,470,063 | A | | 11/1995 | Fisher | |
| 5,489,100 | A | * | 2/1996 | Potter | 473/232 |
| 5,580,051 | A | | 12/1996 | Fisher | |
| 5,597,362 | A | * | 1/1997 | Lee et al. | 473/244 |
| 5,649,870 | A | * | 7/1997 | Harrison | 473/239 |
| 5,722,177 | A | * | 3/1998 | Reilly, III | 33/508 |
| 5,792,006 | A | * | 8/1998 | Hesser | 473/239 |
| 5,863,257 | A | * | 1/1999 | Busnardo | 473/246 |
| 6,213,889 | B1 | | 4/2001 | Hamburger | |

* cited by examiner

*Primary Examiner*—Paul T. Sewell
*Assistant Examiner*—Nini F. Legesse
(74) *Attorney, Agent, or Firm*—Darrell F. Marquette

(57) ABSTRACT

A golf putter, which has a shaft with an adjustable length and a hosel with an adjustable lie angle, is designed for use in custom fitting of golf putters. The golf putter includes a putter head, and the shaft has an upper shaft portion and a lower shaft portion. The hosel includes a first hosel portion extending upwardly from the putter head, and a second hosel portion extending downwardly from the lower shaft portion. The first and second hosel portions are movable relative to each other to adjust the lie angle of the hosel. An elongated rod extends upwardly from the lower shaft portion into the upper shaft portion. The elongated rod is slidably interconnected with the upper shaft portion to adjust the length of the shaft.

7 Claims, 2 Drawing Sheets

GOLF PUTTER WITH ADJUSTABLE SHAFT AND ADJUSTABLE HOSEL

BACKGROUND OF THE INVENTION

This invention relates generally to golf clubs and, in particular, to golf putter having a shaft with an adjustable length and a hosel with an adjustable lie angle.

It is recognized that custom fitting of golf clubs, including golf putters, is important in order to provide a golfer with golf clubs that meet the golfer's physical requirements and personal preferences. For example, the golfer's height, stance and swing are taken into account when custom fitting golf clubs. Typically, a golfer is custom fit for golf clubs by using an array of sample golf clubs with different shaft lengths and lie angles. The golfer may be required to try many of the sample golf clubs before finding one that is acceptable. This is often a time consuming and frustrating process. Also, since the array of sample golf clubs is limited, the one that the golfer finds to be acceptable might not fit the golfer's physical requirements exactly.

U.S. Pat. No. 4,736,951 to T. Grant discloses a golf club with a connector device for connecting a club head to a shaft. In one embodiment, the connector device includes an upper member pivotally connected to a lower member which is pivotally connected to the club head. This allows the shaft to be adjusted relative to the club head into a suitable position which is then indicated by a needle. In another embodiment, the connector device includes locking screws that permit its positioning relative to the club head and its positioning relative to the shaft. One of the locking screws draws a fantail shaped member into locking engagement with a slot in the club head. The other locking screw locks a member which is attached to the shaft to the connector device.

U.S. Pat. No. 5,580,051 to D. Fisher discloses an adjustable golf putter having a putter head and a shaft connected by a gear linkage. One half of the gear linkage includes a gear member connected to the putter head while the other half of the gear linkage includes another gear member connected to the shaft. When the shaft has been adjusted relative to the putter head, a bolt is tightened thereby securing the gear members together and holding the shaft in the adjusted position.

U.S. Pat. No. 6,213,889 to E. Hamburger discloses a golf putter with a hosel assembly for adjustably attaching a shaft to a putter head. One end of the hosel assembly is fastened to the shaft, and the other end of the hosel assembly is pivotally fastened to another member which is pivotally connected to a cam member. Rotation of the cam member changes loft and lie angles of the putter head relative to the shaft.

SUMMARY OF THE INVENTION

The present invention provides a golf putter having a shaft with an adjustable length and a hosel with an adjustable lie angle. The golf putter includes a putter head, and the shaft includes an upper shaft portion and a lower shaft portion. The hosel includes a first hosel portion extending upwardly from the putter head and a second hosel portion extending downwardly from the lower shaft portion. The first and second hosel portions are movable relative to each other to adjust the adjustable lie angle of the hosel to a desired lie angle. An elongated rod connects the lower shaft portion and the upper shaft portion. In the preferred embodiment, the elongated rod is slidably interconnected with the upper shaft portion for adjusting the adjustable length of the shaft to a desired length. Locking means are preferably provided on the upper shaft portion for engagement with the elongated rod to fix the desired length of the shaft. Additional locking means are preferably provided on the first and second hosel portions for locking the first and second hosel portions together to fix the desired lie angle of the hosel. Measurement indicia are marked in spaced increments along the elongated rod to provide an indication of the shaft's desired length, and a scale on the first and second hosel portions provides an indication of the hosel's desired lie angle. Therefore, it is understood that the golf putter provided by the present invention has been designed for use in custom fitting of golf putters.

DESCRIPTION OF THE PREFERRED EMBODIMENT

Figure 1:
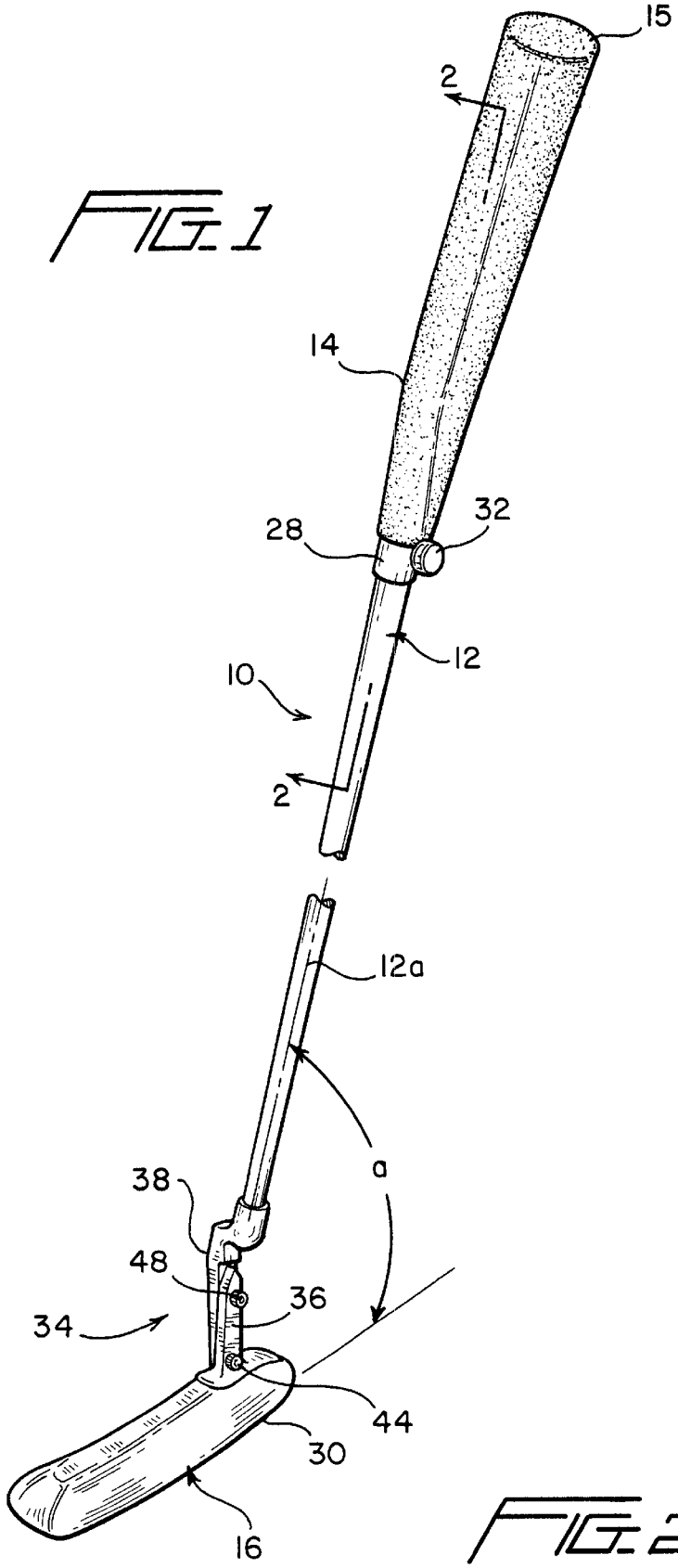
FIG. 1 is a perspective view of the adjustable putter of the present invention.

Referring to the drawings, FIG. 1 shows a golf putter of the present invention which is indicated generally by the reference numeral 10. The golf putter 10 includes a shaft 12 having a grip 14 mounted on one end and a putter head 16 attached to its other end. The shaft 12 has an adjustable length.

Figure 2:
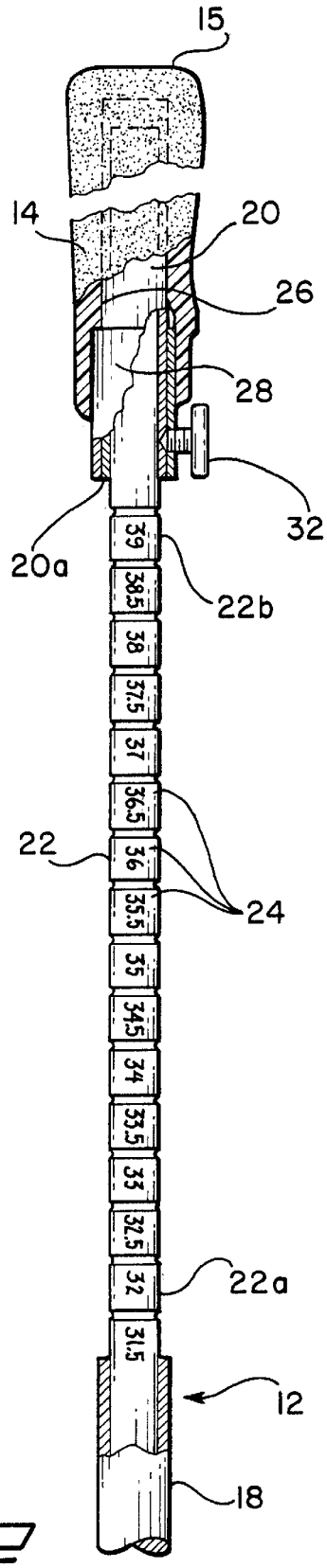
FIG. 2 is an enlarged fragmentary view taken along line 2—2 in FIG. 1 and partially broken away to show various features of the adjustable putter of the present invention.

As seen in FIG. 2, the shaft 12 has a lower shaft portion 18 and an upper shaft portion 20. The lower shaft portion 18 is connected to the putter head 16 as described below and extends upwardly therefrom. An elongated rod 22 is fixed in the lower shaft portion 18 and extends upwardly therefrom. The elongated rod 22 has measurement indicia 24 marked in spaced increments along its length. In the preferred embodiment, the measurement indicia 24 is marked in one-half inch long increments starting at 31.5 inches at a lower end 20*a* of the rod 22 and ending at 39 inches near an upper end 20*b* of the rod 22.

The upper shaft portion 20 extends into a bore 26 in the grip 14 in a conventional manner, and a collar 28 is mounted on a lower end 20*a* of the upper shaft portion 20. The elongated rod 22 extends upwardly from the lower shaft portion 18 into the upper shaft portion 20 and is slidably interconnected with the upper shaft portion 20 for adjusting the adjustable length of the shaft 12 to a desired length. Alternatively, the elongated rod 22 may be fixed in the upper shaft portion 20 and then slidably interconnected with lower shaft portion 18. The putter 10 has a total length which is measured between a bottom surface, or sole, 30 of the putter head 16 and a top surface 15 of the grip 14. Total putter lengths between 31 and 39 inches fit the height and stance requirements of most golfers. Slidably moving the elongated rod 22 within the upper shaft portion 20 moves the desired measurement indicia 24 into alignment with the lower end 20*a* of the upper shaft portion 20 which will adjust the shaft 12 to the desired length. When the shaft 12 is adjusted to the desired length, locking means such as a set screw 32 that is carried in the collar 28 is engaged with the elongated rod 22 to fix the shaft 12 at the desired length.

Figure 3:
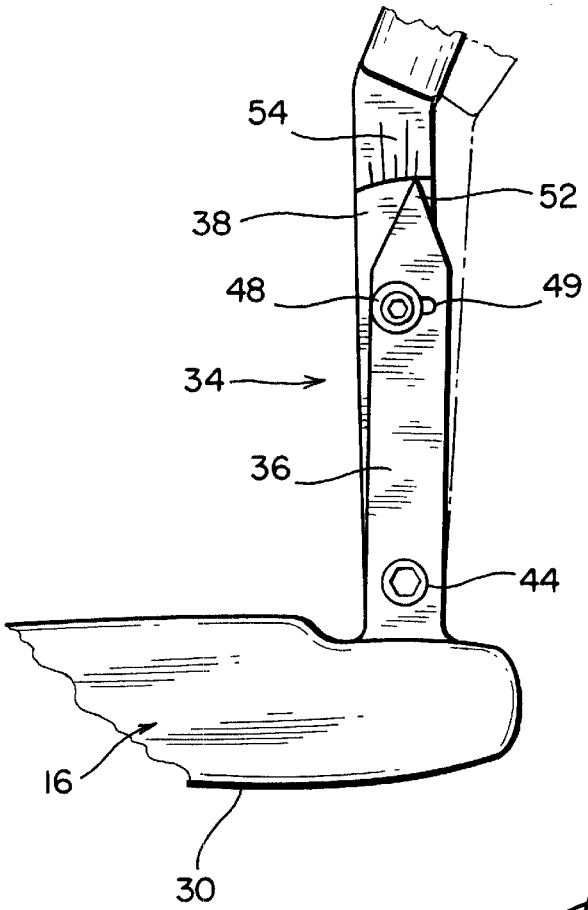
FIG. 3 is a fragmentary front elevational view showing various features of the adjustable putter of the present invention.
Figure 4:
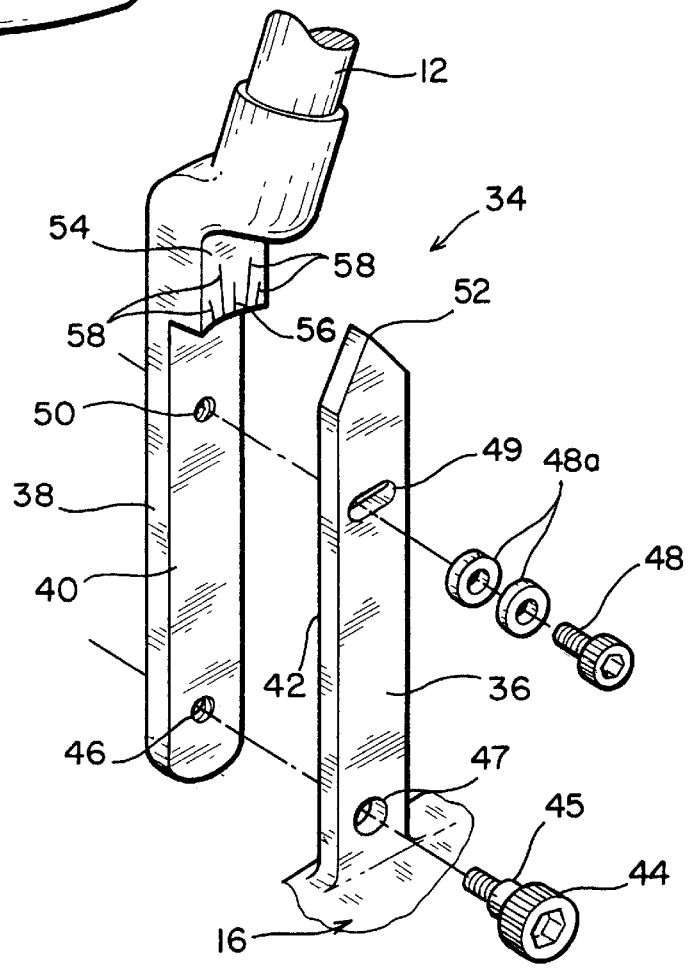
FIG. 4 is an exploded view showing some of the structural details of the adjustable putter of the present invention.

As seen best in FIGS. 3 and 4, the putter head 16 and the shaft 12 are connected to each other by a hosel 34 which has an adjustable lie angle. It will be understood that this adjustable lie angle is the angular relationship between longitudinal axis 12*a* of the shaft 12 and the sole 30 of the putter head 16 as indicated by angle "a" in FIG. 1. The hosel 34 includes a first hosel portion 36 and a second hosel portion 38. The first hosel portion 36 is preferably formed integrally with the putter head 16 and extends upwardly therefrom while the second hosel portion 38 is attached to the lower shaft portion 18 and extends downwardly therefrom. The first and second hosel portions 36, 38 have mating flat surfaces 40 and 42 which lie in a plane that is substantially perpendicular to the sole 30 of the putter head 16. The mating surfaces 40, 42 are elongated and substantially flat. Locking means such as a screw 44 has a shoulder 45 that is disposed in a hole 47 in the first hosel portion 36 and a threaded shank that is engaged with an aligned threaded bore 46 formed in the second hosel portion 38. When the screw 44 is tightened, the mating surfaces 40, 42 of the two hosel portions 36, 38 are held in engagement with each other while the screw 44 provides an axis about which they are movable relative to each other to adjust the angular relationship between the two hosel portions 36, 38, and thus adjust the lie angle "a" of the hosel 34 to a desired lie angle. Another screw 48 extends through a slot 49 formed in the first hosel portion 36 into engagement with an aligned threaded bore 50 formed in the second hosel portion 38. The slot 49 is spaced from the hole 47. The screw 48 stabilizes the two hosel portions 36, 38 and helps the screw 44 lock the two hosel portions 36, 38 in the desired angular relationship.

It will be understood that other means for connecting the first and the second hosel portions 36, 38 and locking them in various angular relationships with respect to each other may be employed. For example, a pivot pin (not shown) could be used instead of the screw 44 and the screw 48 could serve by itself to lock the two hosel portions 36, 38 together.

A scale is provided on the first and second hosel portions 36, 38 to provide an indication of the angular position of the two hosel portions 36, 38 relative to each other and thus the desired lie angle "a" to which the hosel 34 has been adjusted. The scale includes a pointer 52 formed on the first hosel portion 36 and measurement indicia 54 provided on the second hosel portion 38. The measurement indicia 54 includes a central mark 56 with additional marks 58 provided in spaced increments on opposite sides of the central mark 54.

In the preferred embodiment, the maximum range movement of the two hosel portions 36, 38 relative to each other will cause a change of approximately 8 degrees in the lie angle of the hosel 34. For example, if the lie angle is 72 degrees with the two hosel portions 36, 38 in alignment with each other and the pointer 52 aligned with the central mark 56, the lie angle may be reduced by up to 4 degrees to 68 degrees or increased by up to 4 degrees to 76 degrees by movement of the two hosel portions 36, 38 in one direction or the other about their pivot axis which is provided by the screw 44. When the hosel 34 is adjusted to the desired lie angle, tightening of the screws 44, 48 will hold the two hosel portions 36, 38 at the desired lie angle.

It will be understood that 8 degrees of adjustment in the lie angle of a putter may not be enough to cover all the possible lie angles that may be needed for properly fitting golfers that have vastly different physical characteristics, stances and personal preferences. To accommodate the lie angle adjustment range that may be needed, some additional putters, each of which has a different lie angle adjustment range, may be used. Rather than employ a complicated pivot joint, a simple modification in the angle at which the first hosel portion 36 extends from the putter head 16 will provide putters with different lie angle adjustment ranges. It is noted that FIG. 3 shows the first hosel portion 36 extending normally from the putter head 16. Bending, casting or otherwise fabricating the first hosel portion 36 so that it extends upwardly from the putter head 16 at an angle either greater than or less than that shown in FIG. 3 will provide the desired range of lie angle adjustment.

What is claimed is:

1. A golf putter having a shaft with an adjustable length and a hosel with an adjustable lie angle, said golf putter comprising:

a putter head;

said shaft including an upper shaft portion and a lower shaft portion;

said hosel including a first hosel portion extending upwardly from said putter head and a second hosel portion extending downwardly from said lower shaft portion, said first and second hosel portions being movable relative to each other to adjust the adjustable lie angle of said hosel to a desired lie angle;

an elongated rod connecting said lower shaft portion and said upper shaft portion, said elongated rod being slidably interconnected with at least one of said lower shaft portion and said upper shaft portion for adjusting the adjustable length of said shaft to a desired length;

locking means for engagement with said elongated rod to fix the desired length of said shaft;

additional locking means for locking said first and second hosel portions together to fix the desired lie angle of said hosel; and said additional locking means including a screw extending through a hole in said first hosel portion and being engaged with a threaded bore in said second hosel portion, said additional locking means also including another screw extending through a slot in said first hosel portion and being engaged with another threaded bore in said second hosel portion.

2. The golf putter of claim 1, wherein said elongated rod is fixed to said lower shaft portion and slidably interconnected with said upper shaft portion.

3. The golf putter of claim 1, further comprising:

measurement indicia marked in spaced increments along said elongated rod to provide an indication of the desired length of said shaft.

4. The golf putter of claim 1, further comprising a scale on said first and second hosel portions for providing an indication of the desired lie angle of said hosel.

5. The golf putter of claim 4, wherein said scale comprises:

a pointer on said first hosel portion; and measurement indicia marked in spaced increments on said second hosel portion and located adjacent said pointer.

6. The golf putter of claim 1, further comprising:

a grip;

said upper shaft portion being mounted in said grip and having a lower end which depends from said grip;

a collar mounted on the lower end of said upper shaft portion; and said locking means being mounted in said collar.

7. The golf putter of claim 6, wherein said locking means comprises a set screw.

* * * * *